US007051888B2

(12) United States Patent
Antier et al.

(10) Patent No.: US 7,051,888 B2
(45) Date of Patent: May 30, 2006

(54) HINGED CLOSURE DEVICE AND A CONTAINER

(75) Inventors: Gregory Antier, Trevoux (FR); Niels Damkjaer, Kavlinge (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 86 days.

(21) Appl. No.: 10/482,968

(22) PCT Filed: Jul. 11, 2002

(86) PCT No.: PCT/FR02/02460

§ 371 (c)(1),
(2), (4) Date: Jan. 7, 2004

(87) PCT Pub. No.: WO03/006333

PCT Pub. Date: Jan. 23, 2003

(65) Prior Publication Data

US 2004/0178166 A1 Sep. 16, 2004

(30) Foreign Application Priority Data

Jul. 13, 2001 (FR) ..... 01 09422

(51) Int. Cl.
*B65D 39/00* (2006.01)

(52) U.S. Cl. ..... 215/235; 220/831

(58) Field of Classification Search ..... 215/235, 215/237; 220/831, 832; 222/556, 517; B65D 47/08
See application file for complete search history.

(56) References Cited

U.S. PATENT DOCUMENTS

| | | | | |
|---|---|---|---|---|
| 4,158,902 | A | 6/1979 | Chernack et al. | |
| 4,573,600 | A * | 3/1986 | Dubach | 215/237 |
| 5,088,612 | A | 2/1992 | Storar et al. | |
| 5,271,536 | A | 12/1993 | Wilson | |
| 5,368,176 | A * | 11/1994 | Thanisch | 215/235 |
| 5,632,417 | A * | 5/1997 | Robbins et al. | 222/158 |
| 6,415,965 | B1 * | 7/2002 | Nyman et al. | 222/517 |
| 6,478,184 | B1 * | 11/2002 | Berge et al. | 220/831 |
| 6,481,588 | B1 * | 11/2002 | Wagner | 215/235 |

FOREIGN PATENT DOCUMENTS

| | | |
|---|---|---|
| EP | 0926075 | 6/1999 |
| EP | 1086903 | 3/2001 |

* cited by examiner

*Primary Examiner*—Lien M. Ngo
(74) *Attorney, Agent, or Firm*—Dowell & Dowell. P.C.

(57) ABSTRACT

A closure device comprising a plastic lid which is articulated to a skirt that is designed to surround a neck of a container. A majority of the surface of the lid is made up of an external convex surface that is provided with a concave recess which is disposed more or less opposite an area in which the lid is articulated to the skirt. One section of the lid can rest against a heel which is provided close to an upper edge of the skirt so as to lock the lid in a position in which the device is completely open.

12 Claims, 6 Drawing Sheets

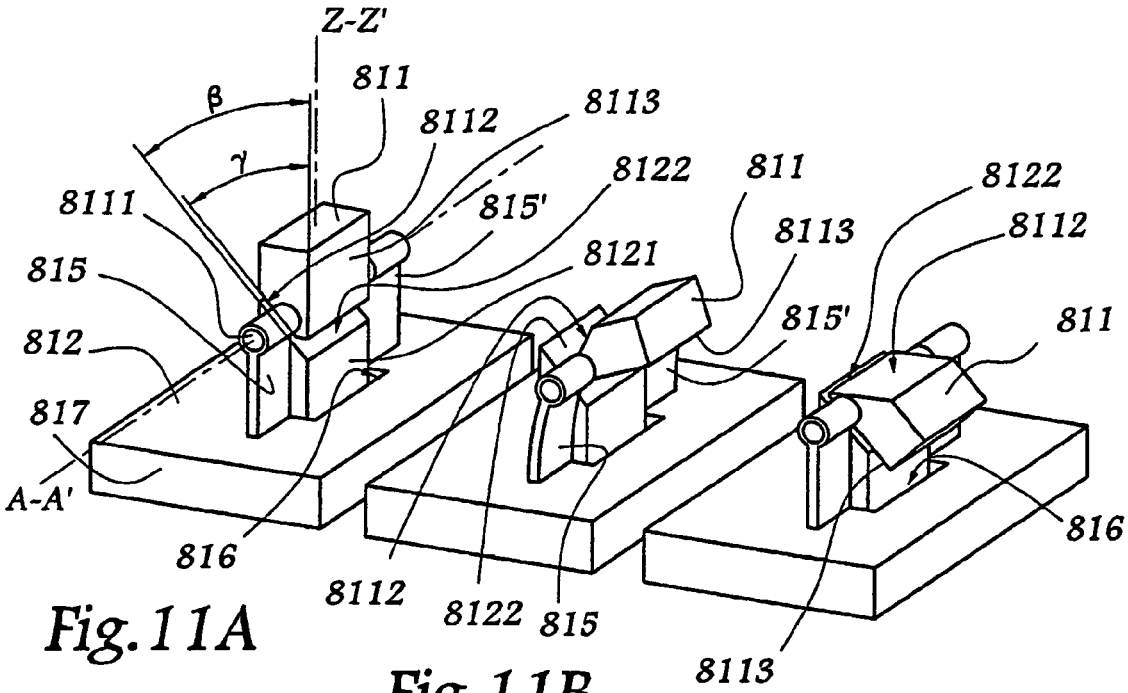
Fig. 11A
Fig. 11B
Fig. 11C
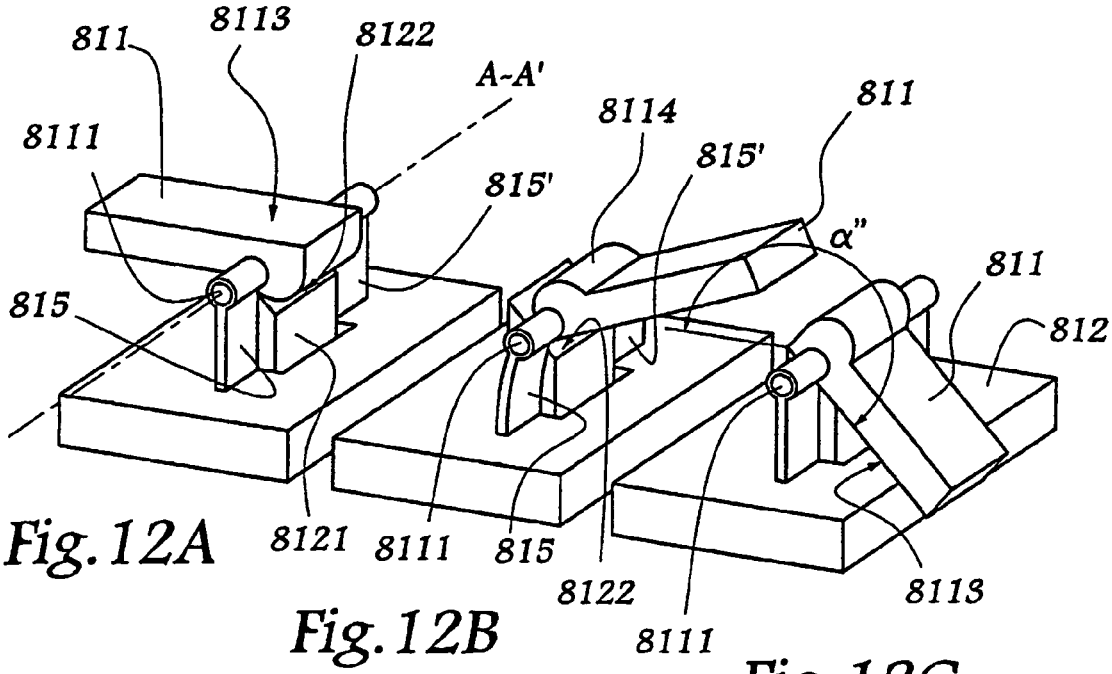
Fig. 12A
Fig. 12B
Fig. 12C

HINGED CLOSURE DEVICE AND A CONTAINER

BACKROUND OF THE INVENTION

1. Field of the Invention

The invention relates to a closure device for a container and to a container provided with such a device.

2. Brief Description of the Related Art

In the domain of packaging liquids, it is known to equip the threaded or non-threaded neck of a bottle with a closure device of plastics material comprising a lid articulated on a skirt, itself provided to be immobilized about this neck. A band or breakable bridges may connect the lid to the skirt before the bottle is first opened. When the lid is tipped from its position of closure towards an open position, it is generally not held with respect to the skirt, with the result that, depending on the direction of inclination of the container, it may interfere with the liquid flowing from the neck. Such a lid can also be a nuisance for a user wishing to drink from the neck of a bottle, particularly for applications in the domain of mineral water or liquid yoghurts.

In certain devices, such as those known from U.S. Pat. No. 4,158,902, from U.S. Pat. No. 5,088,612 or from U.S. Pat. No. 5,271,536, there are provided tongues constituting a hard point for stabilizing an articulated lid in a position making an angle of about 90° with respect to its position of closure of a container. In this position at 90°, the lid may hinder pouring of the contents of the container and prevents a user from drinking from the neck. If the lid is tipped towards its completely open position, it is no longer maintained with respect to the rest of the device and, there again, may be a nuisance.

SUMMARY OF THE INVENTION

It is a more particular object of the invention to overcome these drawbacks by proposing a closure device of which the lid may be efficiently maintained in open position, with the result that it is not a nuisance when the liquid contained in the container is used.

In this spirit, the invention relates to a closure device of a container provided with a neck, this device comprising a lid made of plastics material which is articulated on a skirt designed to surround this neck, characterized in that the lid bears, in its zone of articulation on the skirt, at least one section adapted to rest against a heel provided close to the upper edge of the skirt, in a configuration of blockage of the lid in a position in which the device is completely open.

With the invention, the lid is efficiently maintained in completely open position due to the cooperation of the afore-mentioned section and heel. Within the meaning of the present invention, the completely open position of the device is the one in which the lid is pivoted towards its position of tipping in which it provides access to the rest of the device and to the neck of the container, the most. This completely open position corresponds to an angle of opening of the lid substantially greater than 90°. It will be noted that the stable nature of the opening of the lid is obtained without having to resort to a hinge provided with a spring, such a hinge being notably more complicated and more difficult to mold than the mechanism of the invention.

According to advantageous but non-obligatory aspects of the invention, the device incorporates one or more of the following characteristics:

The geometry and positioning of the afore-mentioned section of the lid and of the heel are such that the angle of opening of the lid, in completely open and blocked position, is greater than or equal to 180°. Under these conditions, the lid is disengaged from the neck during the pouring of a liquid contained in the container or when a person wishes to drink from the bottle.

According to certain advantageous forms of embodiment of the invention, the afore-mentioned section of the lid is formed between two elastic lamellae which form a hinge and connect the lid and the skirt. According to a variant embodiment of the invention, two sections are provided on the lid to rest against a heel, these sections being distributed on either side of an elastic lamella forming hinge and joining the lid and the skirt. In any case, the abutment of the section of the lid on the heel may be obtained by an elastic effort exerted by the lamellae.

According to a first advantageous form of embodiment of the invention, the heel may be formed by a part of the upper edge of the neck.

According to another advantageous embodiment of the invention, the heel may be formed by a tongue in one piece with the skirt and extending upwardly from its upper edge. In that case, this tongue may come into abutment, under the effect of an effort exerted by the afore-mentioned section of the lid, against the outer radial surface of the neck and transmit to that section an effort of reaction generated by the neck.

Such a lid may have a convex outer shape in order to give it a satisfactory aesthetic appearance and to avoid the accumulation of liquid or dirt on its upper surface. When such a lid has been opened, it is sometimes difficult to fold it down towards its position closing the neck of the container, as the fingers of a user slide on the edge of the lid opposite its zone of articulation on the skirt. In particular, it is often necessary to close a bottle with both hands, by holding the neck of the bottle in one hand while the other hand exerts an effort of closure of the closure device.

For certain types of drinks, it is desirable to be able to close a closure device in particularly easy manner, for example with one hand, and the known devices do not give satisfaction under these conditions.

In order to solve this problem, the invention also relates to a closure device of the afore-mentioned type of which the lid has a convex outer face over the greater part of its surface, while this outer face is provided with a concave depression made substantially opposite the zone of articulation of the lid on the skirt.

Thanks to the invention, the depression formed on the outer face of the lid constitutes a zone for receiving the end of a user's finger, which makes it possible to exert an efficient effort to fold the lid down, limiting the risks of the user's finger sliding with respect to the outer surface of the lid.

According to an advantageous aspect of the invention, the surface state of the depression is different from the surface state of the convex part of the outer face of the lid. In particular, the depression may be provided to have a rougher surface than the convex part. Thus the coefficient of friction of the user's finger with this depression is relatively high, which further limits the risks of slide. In addition, the depression advantageously joins an upper face of a nose projecting radially from the edge of the lid, this nose making it possible to exert on the lid an effort of opening of the device.

The invention also relates to a container provided with a neck and equipped with a closure device as described previously.

BRIEF DESCRIPTION OF THE DRAWINGS

The invention will be more readily understood and other advantages thereof will appear more clearly in the light of the following description of four forms of embodiment of a closure device in accordance with its principle and of the modelization of two hinges adapted to be used in one or the other of these devices, given solely by way of example and made with reference to the accompanying drawings, in which:

FIGS. 11A, 11B and 11C are models which illustrate the articulation between a lid and the fixed part of a closure device incorporating certain characteristics of the present invention, and FIGS. 12A, 12B and 12C are views similar to FIGS. 11A to 11C for another articulation.

FIGS. 11A, 11B and 11C are modelizations of the articulation between a lid and the fixed part of a closure device incorporating certain characteristics of the present invention, and FIGS. 12A, 12B and 12C are views similar to FIGS. 11A to 11C for another articulation.

DESCRIPTION OF THE PREFERRED EMBODIMENT

Figure 1:
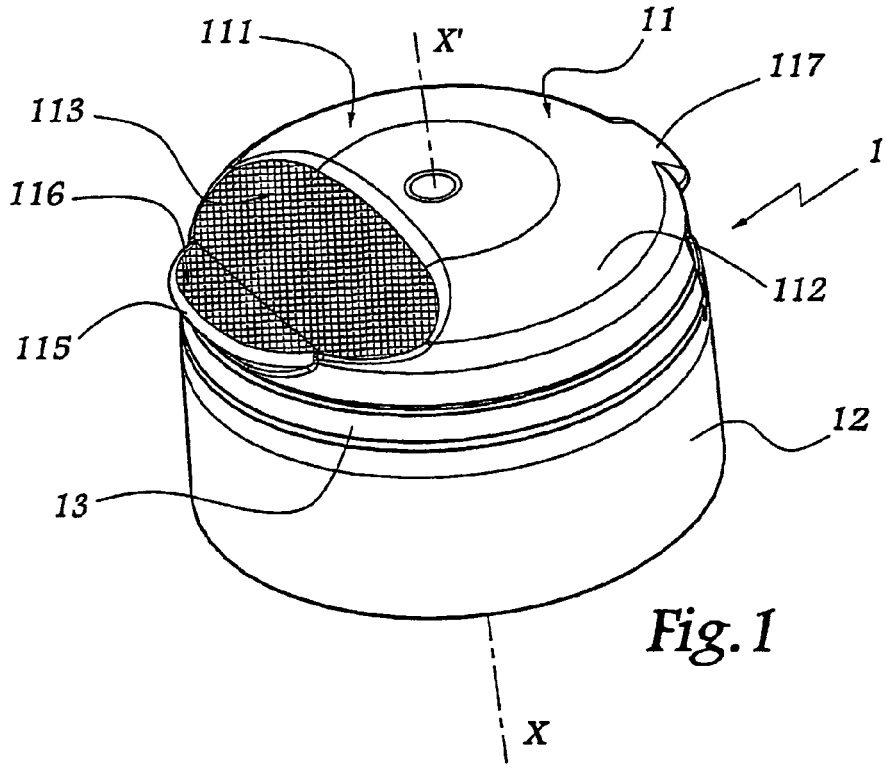
FIG. 1 is a view in perspective of a closure device according to the invention.

The closure device 1 shown in FIGS. 1 to 6 is provided to be mounted on the neck 2 of a bottle 3 of which only the upper part is visible in FIGS. 3 to 6.

The device 1 comprises a lid 11 and a skirt 12 which are substantially symmetrical with respect to a central axis X–X' of the device 1.

The device 1 is in one piece and made by molding plastic material. A tearable band 13 connects the lid 11 and the skirt 12 over an essential portion of the periphery of the device 1, except for a zone 14, more particularly visible in FIG. 2, in which the lid 11 is articulated on the skirt 12.

The skirt 12 is provided with an inner rib 121 intended to cooperate with an outer annular flange 21 of the neck 2 in order to immobilize the device 1 on the neck 2.

Two elastic lamellae 15 and 15' connect the lid 11 and the skirt 12, on either side of a tongue 122 extending upwardly from the upper edge 123 of the skirt 12.

Figure 2:
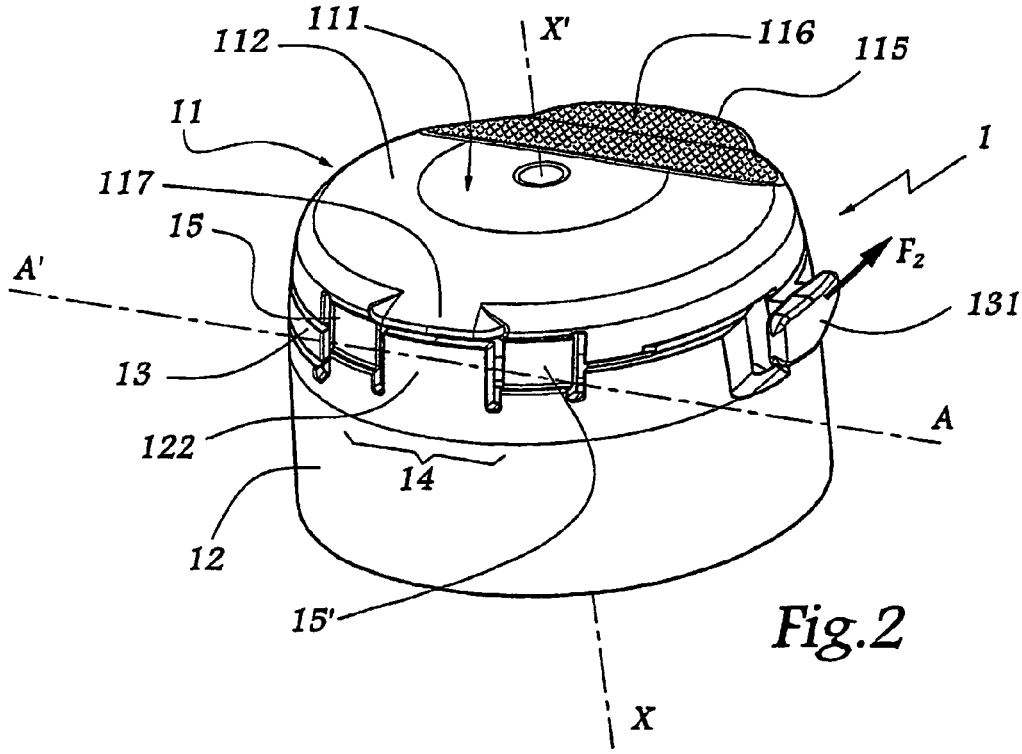
FIG. 2 is a view in perspective of the device of FIG. 1, seen from another angle.

In the present description, the adjectives "upper" and "lower" are defined with reference to a lid placed flat on a substantially horizontal surface in the position of FIGS. 1 and 2. The upper parts of the device 1 are oriented upwardly in the Figures, while the lower parts are oriented downwardly.

The upper or outer face 111 of the lid 11 is convex, i.e. presents a marked convexity, on a principal part 112 corresponding to the major part of the face 111.

A depression 113 is provided in this face 111, opposite the zone 14, this depression 113 being concave, i.e. forming a hollow with respect to the principal part 112. This depression 113 constitutes a natural zone for exerting an effort on the lid 11.

When the device 1 is mounted on the neck 2 of the bottle 3 and when it is desired to open this bottle, an effort $F_2$ for tearing the band 13 is made on a grip 131 of the band 13, this making it possible to release the edge 114 of the lid 111 from its connection with the skirt 12 over the major part of the periphery of the device 1. It is then possible to tip the lid 11 about a geometrical axis A–A' substantially perpendicular to axis X–X' by exerting a suitable effort $F_3$ on a nose 115 of the lid 11. The nose 115 projects radially with respect to the edge 114 of the lid 11 opposite the zone 14.

Figure 3:
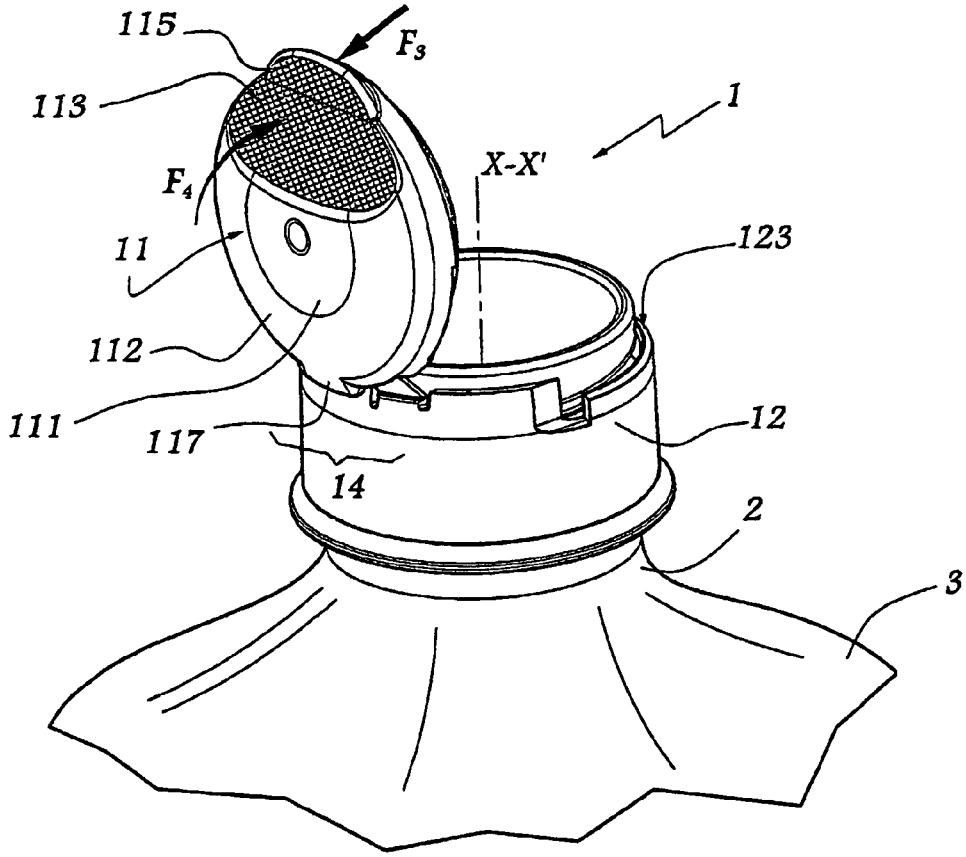
FIG. 3 is a view in perspective of the device of FIGS. 1 and 2 mounted on the neck of a bottle and in the course of being opened.
Figure 4:
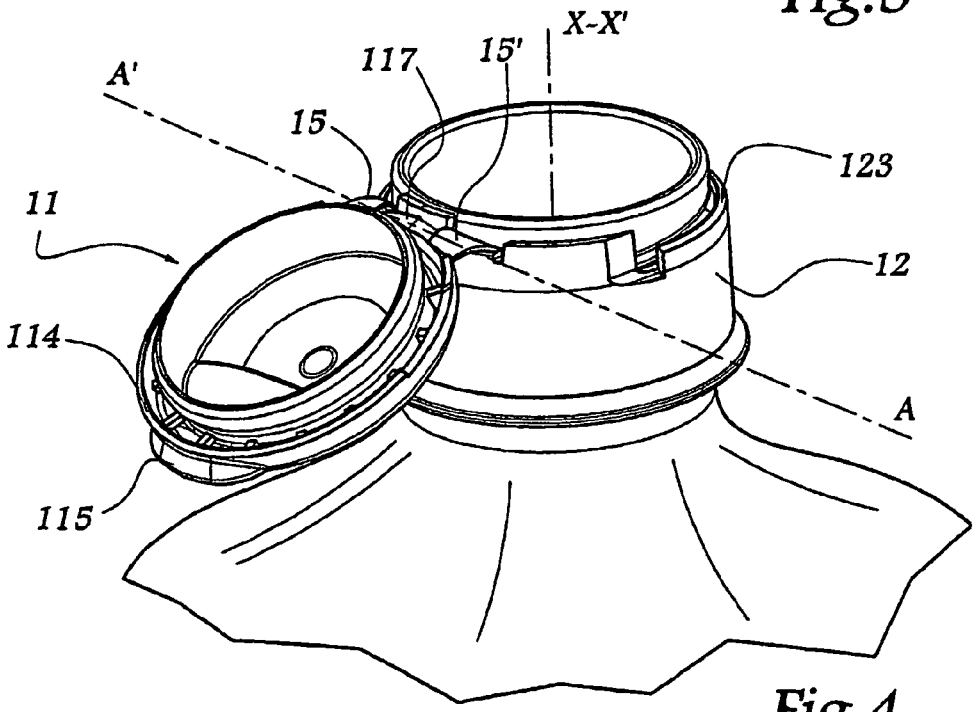
FIG. 4 is a view similar to FIG. 3 at the end of the movement of opening of the lid.
Figure 5:
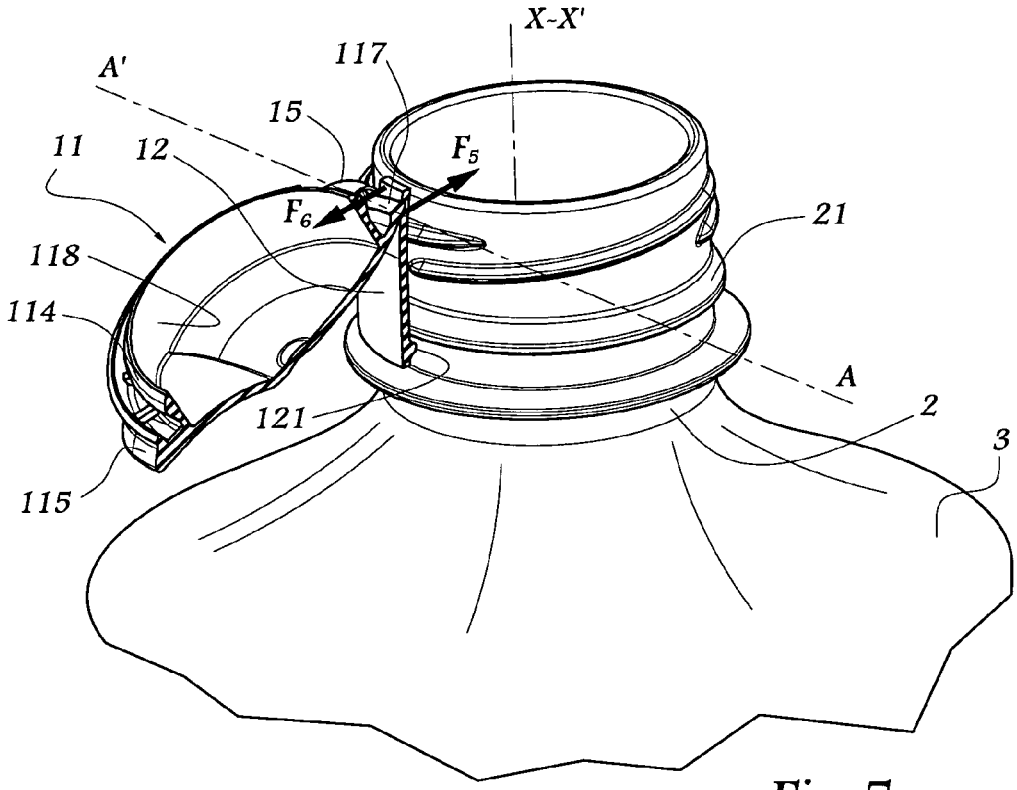
FIG. 5 is a view similar to FIG. 4, with parts of the closure device torn away.
Figure 6:
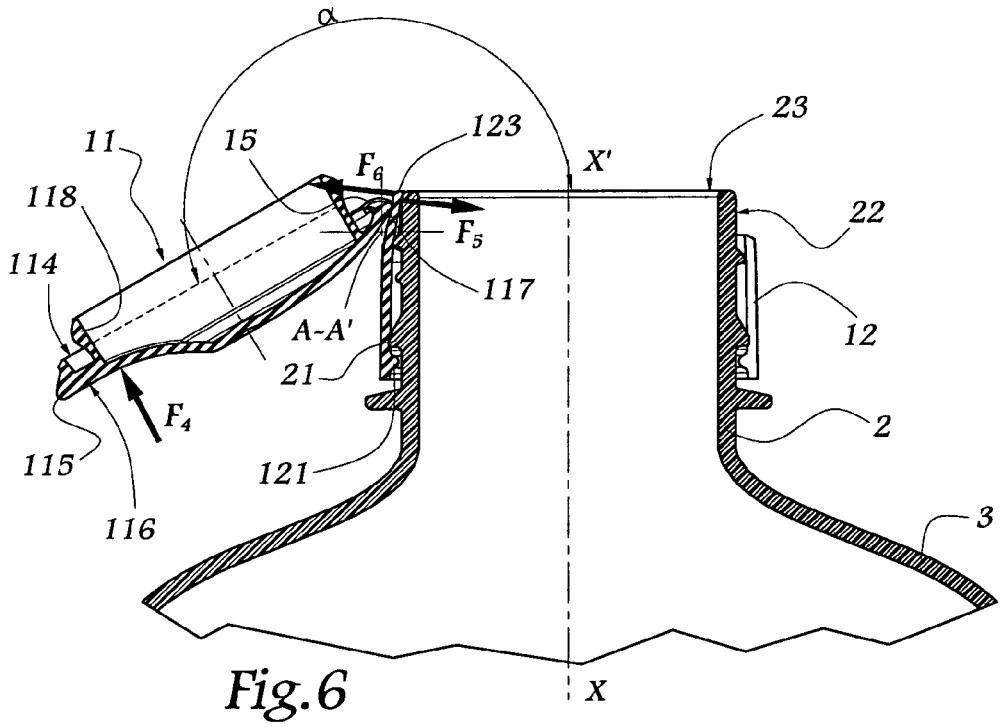
FIG. 6 is an axial section through the bottle and the device in the configuration along line VI—VI of FIG. 4.

This makes it possible to cause the lid to pass from the configuration of FIGS. 1 and 2 to that of FIGS. 4 to 6, via that of FIG. 3.

When the device 1 is to be closed again, it is possible to exert an effort $F_4$ on the depression 113.

Taking into account the shape of this depression, this effort $F_4$ may be exerted with one finger of a hand, of which the other fingers are at the level of the skirt 12. In this way, it is possible to close the device 1 easily, i.e. to tip the lid 11 to return it into its position of FIGS. 1 and 2.

The depression 113 is provided to be rougher than the principal part 112 of the face 111, in order that the effort $F_4$ can be exerted without risk of slide of a user's finger. For example, the surface 113 may be grained or striated.

Furthermore, the upper face 116 of the nose 115 prolongs the depression 113, with the result that the surface on which the effort $F_4$ may be exerted is increased accordingly.

The lid 11 is also provided with a projection 117 extending substantially opposite the nose 115 with respect to axis X–X', i.e. in zone 14.

During pivoting of the lid 11 about axis A–A', the projection 117 comes to rest by the outside against the tongue 122 under the effect of an elastic effort $F_5$ exerted by the lamellae 15 and 15'. Due to this effort $F_5$, the tongue 122 is applied against the outer radial surface 22 of the neck 2, in the vicinity of its upper edge 23, this surface 22 exerting an effort of reaction $F_6$ on the projection 117, the direction and the intensity of the efforts $F_5$ and $F_6$ being such that the lid 11 is blocked in the position of FIGS. 4 to 6.

In the position of FIGS. 4 to 6, the tongue 122 is compressed between the section 117 and the neck 2. This tongue 122 extends, from the skirt 12, up to above the geometrical axis A–A' of articulation of the lid 11 on the skirt 12. In this position, it will be noted that the angle of opening $\alpha$ of the lid 11 is greater than 180°, with the result that access to the neck 2 is clearly disengaged, even though the lid 11 is provided with an inner skirt 118. In this way, the lid 111 does not risk hindering a user who is pouring the contents of the bottle, whatever the orientation of the lid 11 about axis X–X'. Moreover, the lid 11 does not hinder a person wishing to drink directly from the neck of the bottle 11.

It will also be noted that the closure device of the invention presents the particular advantage of being able to be molded in the configuration of FIGS. 1 and 2, i.e. in closed configuration, in which it may be directly mounted on the neck 2 of the bottle 3. Molding in closed configuration allows a greater density of the impressions in the manufacturing mold.

Section 117 of the lid 11 does not project to too great a degree with respect to the edge of the lid, with the result that it does not hinder its manipulations by automated devices for positioning it on the neck. In addition, section 117 does not risk injury to a user.

Figure 7:
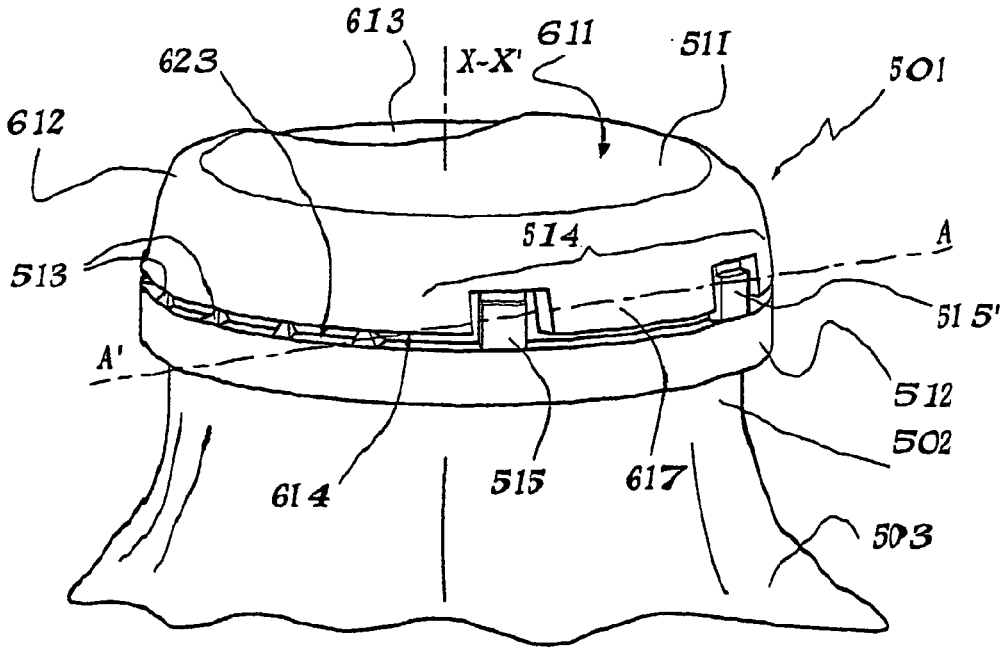
FIG. 7 is a view in perspective of a lid in accordance with a second form of embodiment of the invention.
Figure 8:
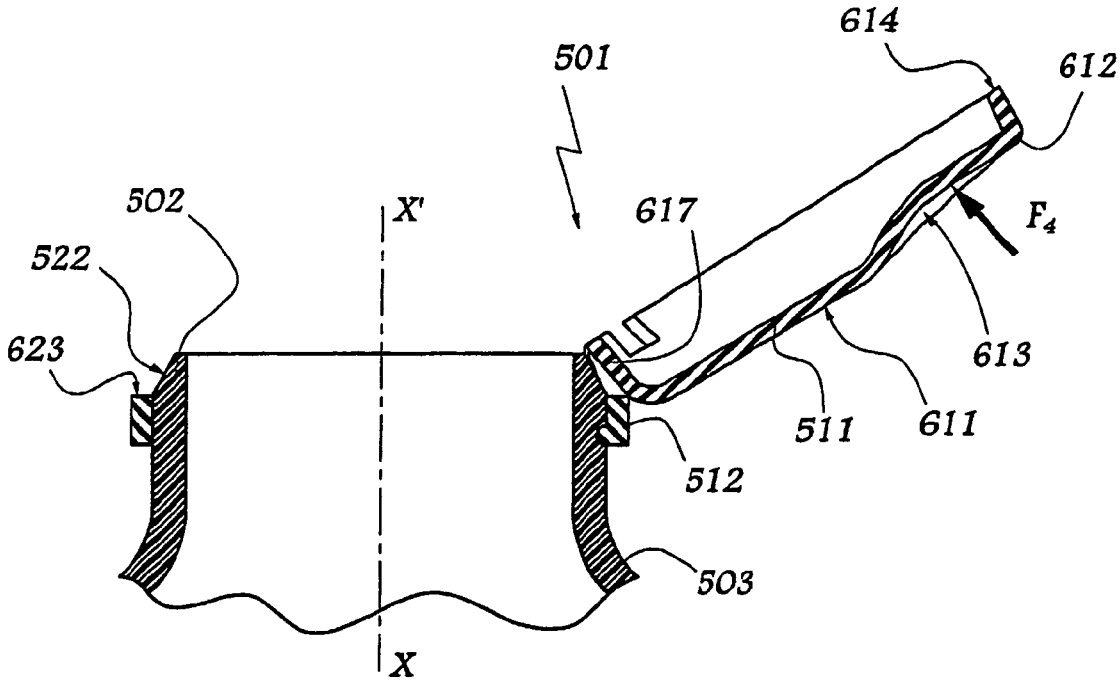
FIG. 8 is a view in section of the lid of FIG. 7, in open configuration.

In the second form of embodiment of the invention shown in FIGS. 7 and 8, elements similar to those of the first embodiment bear identical references increased by 500. The device 501 of this embodiment is provided to be mounted on the neck 502 of a bottle 503. A lid 511 is articulated on a skirt 512 thanks to elastic lamellae 515 and 515' formed in a zone of articulation 514.

Projecting elements 513 extend from the upper edge 623 of the skirt 512 and are connected in breakable manner to the lower edge 614 of the lid 511.

As previously, the outer surface 611 of the lid 511 comprises a principal part 612 of which the edges are rounded and of which the top is substantially planar. This part 612 is therefore convex. A depression 613 is formed on the lid 511 substantially opposite the zone 514. This depression allows an efficient transmission of effort when the lid is to be closed again, as represented by arrow $F_4$ in FIG. 8.

A projection 617 is provided on the lid 611 between the lamellae 515 and 515', this projection coming into abutment against the upper edge 522 of the neck 502, as shown in FIG. 8. This makes it possible to immobilize the lid 511 in the open position shown in this Figure, with the combining of efforts similar to efforts $F_5$ and $F_6$ mentioned with reference to the first embodiment.

Figure 9:
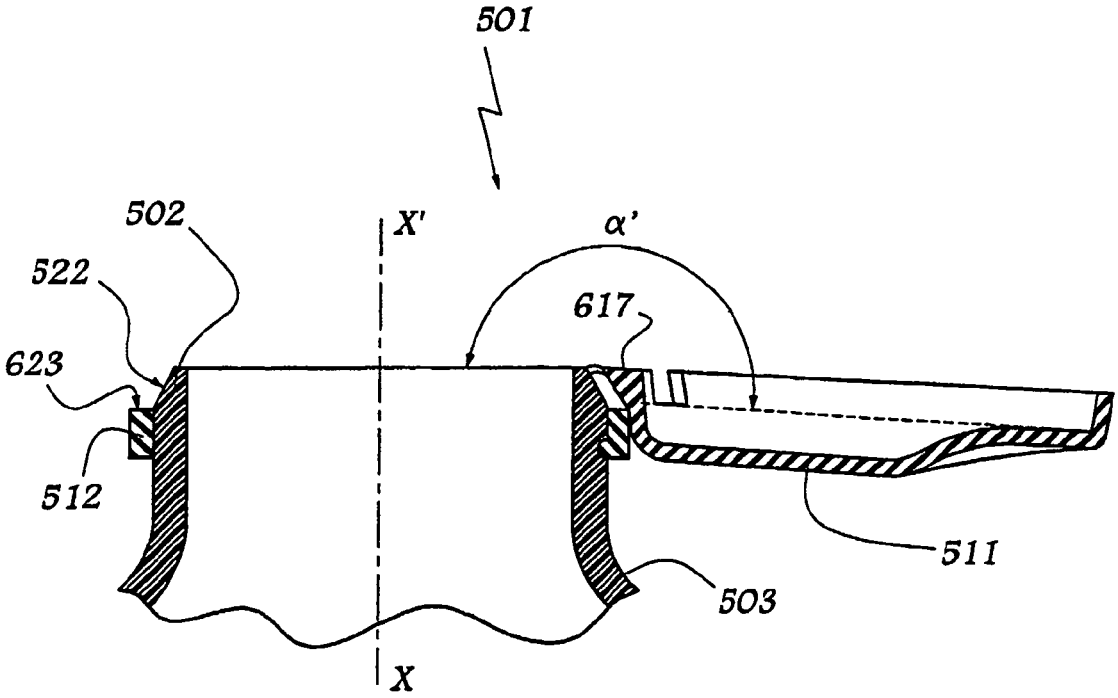
FIG. 9 is a view similar to FIG. 8 for a closure device in accordance with a third form of embodiment of the invention.

As shown in FIG. 9, where elements similar to those of the second embodiment bear identical references, the shape of the section 617 may be modified in a third embodiment so that, in open and blocked configuration, the angle of opening $\alpha'$ of the lid 511 is greater than 180°.

As previously, the section 617 comes into abutment against the upper edge 522 of the neck 502, above the upper edge 623 of the skirt 512.

Figure 10:
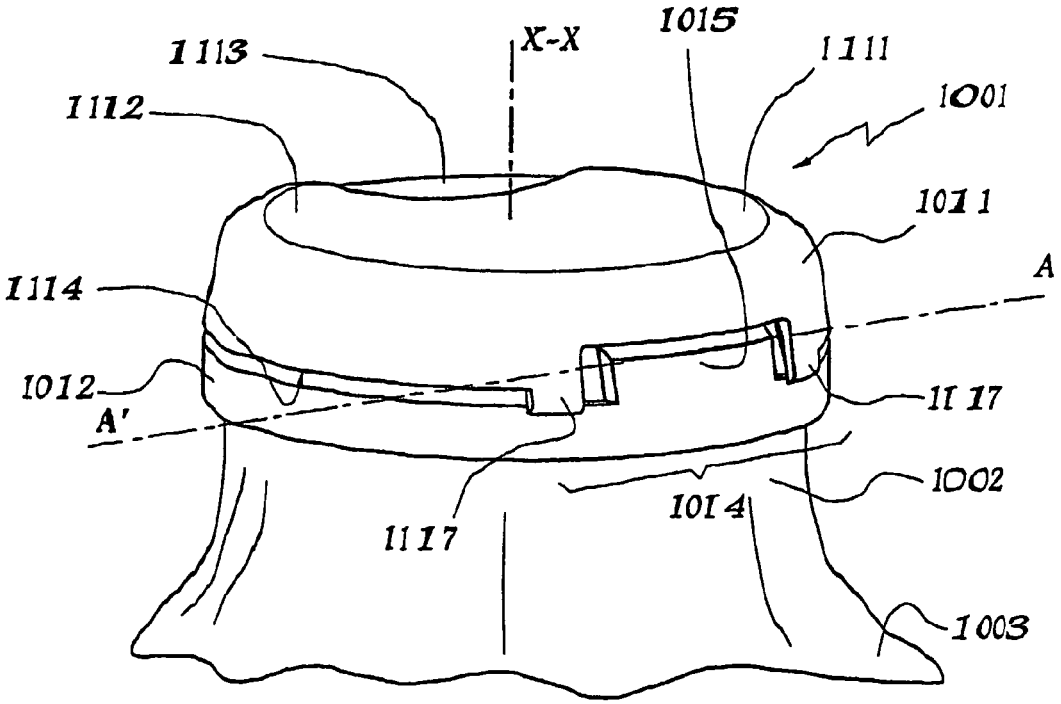
FIG. 10 is a view similar to FIG. 7 for a closure device in accordance with a fourth form of embodiment of the invention.

As shown in FIG. 10, where elements similar to those of the first embodiment bear identical references increased by 1000, there may be provided, in a zone of articulation 1014 between a lid 1011 and a skirt 1012, two sections 1117 and 1117' extending downwardly from the lower edge 1114 of the lid 1011 in the direction of the skirt 1012, this skirt being intended to be disposed around the neck 1002 of a bottle 1003.

An elastic lamella 1015 connects the lid 1101 and the skirt 1012 and constitutes a hinge for articulation about an axis X–X' substantially perpendicular to an axis of symmetry X–X' of the neck 1002 and of the closure device 1001.

As previously, the outer face 1111 of the lid 1011 comprises a first convex principal part 1112 and a concave depression 1113.

In open configuration of the device 1001, the projecting sections 1117 and 1117' come respectively into abutment against the upper edge of the neck 1002 on either side of the lamella 1015. The geometry of the sections 1117 and 1117' may be chosen so that the angle of opening of the lid 1011 in blocked position is greater than 180°.

As shown in FIGS. 11A and 11C, another articulation may be envisaged in which elastic lamellae 815 and 815' connect a part 811 of a device, which may correspond to a lid, to another part 812, which may correspond to a skirt. The part 812 comprises a central stud 8121 of which the upper surface 8122 is inclined by an angle $\beta$ equal to about 45° with respect to a central axis Z–Z'of the stud 8121.

Furthermore, part 811 is provided with pins 8111 allowing it to pivot about an axis A–A' with respect to the upper ends of the lamella 815 and 815'.

In the position of FIG. 11A, the lower surface 8112 of part 811 is inclined by an angle $\gamma$ with respect to axis Z–Z' which is substantially equal to angle $\beta$.

When part 811 is rotated about axis A–A', the lamellae 815 and 815' tend to be drawn, due to the difference in length of the parts 811 and 812 in contact, then these lamellae contract again, firmly applying a lateral surface 8113 of part 811 against the surface 8122 of part 812, as shown in FIG. 10C. In this position, part 811 is maintained in folded down position with respect to part 812, by reason of the elastic effort due to the lamellae 815 and 815'.

Such a structure might be used as bi-stable hinge for the lid of the three closure devices described hereinabove.

This form of embodiment presents the particular advantage that the hinge thus constituted is stable in the two positions shown respectively in FIGS. 11A and 11C.

As shown in FIGS. 12A to 12C, it is possible to modify the hinge shown in FIGS. 11A to 11C so that its angle of opening $\alpha''$ is greater than 180°. In that case, part 811 is provided with a part 8114 in the form of a frustum of cylinder centered on the axis A–A' of rotation defined by the pins 8111 and by the upper parts of the lamellae 815 and 815'.

During the movement of opening of the hinge thus constituted, the cylindrical surface of part 8114 slides against the upper surface 8122 of the stud 8121 of the fixed part 812, which makes it possible to obtain a movement of opening of great angular amplitude $\alpha''$.

In the configuration of FIG. 12C, the hinge is stable thanks to the surface bearing of the lateral surface 8113 of part 811 on the surface 8122 of the stud 8121.

The invention claimed is:

1. A closure device for a container provided with a neck, said closure device comprising; a lid made of plastic material, articulation means for connecting said lid along a portion thereof to a skirt designed to surround and be mounted to the neck, said lid including at least one projection along said portion thereof that engages against a tongue member provided along an upper edge of said skirt when said lid is moved from a closed position relative to the neck of the container to a completely open position relative to the neck, and whereby said tongue is thereby forced against the neck to thereby create a reactive force against said at least one projection to retain said lid in said completely open position.

2. The device according to claim 1 wherein a geometry and positioning of said projection and of said tongue member are such that an angle of said lid relative to said closed position, when said lid is completely open and retained, is greater than or equal to 180°.

3. The device according to claim 2 wherein said projection is formed between two elastic lamellae that form said articulation means and function as hinges connecting said lid (11; 511; 811) and said skirt (12; 512; 812).

4. The device according to claim 1 wherein said tongue member is in one piece with said skirt and extends upwardly from an upper edge (123) of said skirt.

5. The device according to claim 4 wherein said tongue member is adapted to come into abutment, least one under the effect of an effort ($F_5$), exerted by said at least one projection of said lid (11), against an outer radial surface of said neck (502) and to transmit to said at least one an effort of reaction ($F_6$) generated by said neck.

6. The closure device of claim 1 wherein said lid includes a convex outer face over a major part of a surface thereof, said outer face being provided with a concave depression made substantially opposite said portion thereof where said articulation means connects said lid on said skirt.

7. The device according to claim 6 wherein surface characteristics of said depression are different from surface characteristics of said convex part of said outer face.

8. The device according to claim 7 wherein said depression has a rougher surface than said convex part.

9. The device according to claim 6 wherein said depression is connected to an upper face (116) of a nose projecting radially from said lid.

10. A container comprising a container body provided with a neck, and a closure device according to claim 6.

11. A container comprising a container body provided with a neck, and a closure device according to claim 1.

12. The device according to claim 3 wherein an elastic effort ($F_5$) is exerted by said lamellae urging said at least one projection against said tongue member.

* * * * *